US006040573A

United States Patent [19]

Sporleder et al.

[11] Patent Number: 6,040,573

[45] Date of Patent: Mar. 21, 2000

[54] ELECTRIC FIELD GENERATION FOR CHARGED PARTICLE ANALYZERS

[75] Inventors: C. Ray Sporleder; David E. Clemmer, both of Bloomington, Ind.

[73] Assignee: Indiana University Advanced Research & Technology Institute Inc., Bloomington, Ind.

[21] Appl. No.: 08/937,729

[22] Filed: Sep. 25, 1997

[51] Int. Cl.[7] ..... H01J 49/42

[52] U.S. Cl. ..... 250/281; 250/286; 250/290; 250/291; 250/292

[58] Field of Search ..... 250/281, 282, 250/286, 287, 290, 291, 292, 305; 445/49

[56] References Cited

U.S. PATENT DOCUMENTS

| | | | |
|---|---|---|---|
| 4,261,698 | 4/1981 | Carr et al. . | |
| 4,317,029 | 2/1982 | Warthan . | |
| 4,443,319 | 4/1984 | Chait et al. . | |
| 4,870,283 | 9/1989 | Taya . | |
| 4,985,626 | 1/1991 | Margulies | 250/290 |
| 5,070,240 | 12/1991 | Lee et al. . | |
| 5,109,157 | 4/1992 | Loen . | |
| 5,117,107 | 5/1992 | Guilhaus et al. . | |
| 5,147,522 | 9/1992 | Sarrine . | |
| 5,148,021 | 9/1992 | Okamoto et al. . | |
| 5,154,625 | 10/1992 | Borokowski et al. . | |
| 5,162,649 | 11/1992 | Burke . | |
| 5,245,185 | 9/1993 | Busch et al. . | |
| 5,280,175 | 1/1994 | Karl . | |
| 5,283,436 | 2/1994 | Wang . | |
| 5,302,827 | 4/1994 | Foley . | |
| 5,451,781 | 9/1995 | Dietrich et al. | 250/290 |
| 5,468,958 | 11/1995 | Franzen et al. . | |
| 5,510,613 | 4/1996 | Reilly et al. . | |
| 5,563,571 | 10/1996 | Sobhani . | |
| 5,600,293 | 2/1997 | Hunter . | |

OTHER PUBLICATIONS

Herbert H. Hill, Jr., William F. Siems, and Robert H. St. Louis, Ion Mobility Spectrometry, Analytical Chemistry, vol. 62, No. 23, Dec. 1, 1990.

Abstract, Lab on a Chip Uses Semiconductor Fab Technology, 1997.

*Primary Examiner*—Kiet T. Nguyen

*Attorney, Agent, or Firm*—Woodard, Emhardt, Naughton Moriarty & McNett

[57] ABSTRACT

A technique to produce a device for generating an electric field is disclosed. This electric field may be customized to direct movement of charged particles in a predetermined manner. Moreover, this device is readily installed and removed from a charged particle analyzer to facilitate interchange with other devices capable of generating electric fields with different characteristics. The device may be provided by etching an electrically conductive layer clad to a flexible dielectric substrate to define a predetermined conductive pattern. This pattern is then oriented relative to a charged particle pathway and an electric potential applied to generate the desired electric field.

41 Claims, 9 Drawing Sheets

ELECTRIC FIELD GENERATION FOR CHARGED PARTICLE ANALYZERS

BACKGROUND OF THE INVENTION

The present invention relates to the generation of electric fields to control movement of charged particles, and more particularly, but not exclusively, relates to the design and construction of devices to provide customized electric fields for charged particle analyzers.

When evaluating the composition of a substance, it is often desirable to study the behavior of charged particles taken from a sample of the substance of interest. Typically, the charged particles are liberated from the sample in the form of atomic or molecular ions—although in some instances it may be desirable to study subatomic particles bearing a charge. Various types of analyzers have been developed to facilitate the evaluation of charged particles, including ion mobility detectors, time of flight mass spectrometers, multipole mass spectrometers, and cyclotrons to name a few. U.S. Pat. No. 5,510,613 to Reilly et al., U.S. Pat. No. 5,504,326 to Reilly et al., U.S. Pat. No. 5,302,827 to Foley, U.S. Pat. No. 5,280,175 to Karl, U.S. Pat. No. 5,162,649 to Burke, U.S. Pat. No. 5,148,021 to Okanoto et al., U.S. Pat. No. 5,117,107 to Guilhaus et al., and U.S. Pat. No. 5,109,157 to Leon provide representative examples of various types of instruments directed to charged particle evaluation.

The application of charged particle analysis to the evaluation of biomolecules is one area in which there is increasing interest. Of particular interest is the mass sequence analysis of peptides, proteins, DNA fragments, sugars, and glycoproteins. Indeed, it is hoped that the spectroscopic evaluation of ions from biomolecules will provide more capable and cost-effective medical diagnostic equipment.

Central to the operation of most charged particle analyzers is the controlled generation of one or more electric fields (E-fields). Typically, analyzers utilize electric fields to accelerate, separate, and otherwise selectively direct charged particles. Expanded application of charged particle analysis often entails the careful design of an electric field tailored with various predetermined characteristics. Electric field gradient and spatial orientation of the electric field relative to the desired pathway of charged particles within the analyzer are examples of such characteristics.

For mass spectrum analyzers, the generation of a desired electric field frequently results in a complicated arrangement of numerous, expensively machined metal parts (sometimes called "lenses"). Typically, these lenses are spaced apart from each other along a tube, electrically interconnected, and then coupled to a voltage source to provide the desired electric field. The accurate orientation of these parts relative to each other and to the tube is often essential to generation of an electric field with the desired properties. Unfortunately, accurate assembly is very tedious and time consuming, and frequently presents a significant obstacle to obtaining the ideal electric field. Even if an acceptable electric field is finally obtained through careful adjustment of the various parts, the assembly is routinely torn down for cleaning as it becomes contaminated with the samples that pass through the tube. Disassembly, cleaning, and reassembly result in significant equipment downtime. In addition, this repeated assembly and disassembly subjects the parts to greater wear and tear.

In order to more readily advance charged particle analyzers to new applications, the ability to more rapidly and cost-effectively change electric field characteristics is in demand. The complex assembly and disassembly process associated with conventional charged particle analyzer lenses significantly impede such advancements. Furthermore, the multipiece arrangement of metal lenses limit the available electric field gradient and generally make analyzers larger—with a correspondingly higher power consumption—than would otherwise be desired.

Thus, there is a need for a simpler, more cost-effective technique to generate electric fields for charged particle analyzers. Preferably, this technique should reduce analyzer downtime and provide for the rapid interchange of components necessary to change electric field characteristics. The present invention satisfies these needs and provides other significant advantages.

SUMMARY OF THE INVENTION

The present invention relates to electric field generation for charged particle analyzers. Various aspects of the invention are novel, non-obvious, and provide various advantages. While the actual nature of the invention covered herein can only be determined with reference to the claims appended hereto, certain features which are characteristic of the preferred embodiments disclosed herein are described briefly as follows.

One feature of the present invention is a technique to produce a device for generating an electric field. This electric field may be customized to direct movement of charged particles in a predetermined manner. Moreover, this device may be readily installed and removed from a charged particle analyzer to facilitate interchange with other devices capable of generating electric fields with different characteristics.

In accordance with another feature of the present invention, a spatial pattern of electric field lenses is defined that corresponds to an electric field for controllably moving ions in an analyzer along a predetermined pathway. An etch resist is applied to a conductive material clad to a flexible dielectric substrate in accordance with the designed spatial pattern. An exposed portion of the conductive material is removed by an etchant, which results in a spatial arrangement of conductive material corresponding to the pattern of lenses. The electric field is generated by applying an electric potential to the spatial arrangement of conductive material.

In another feature of the present invention, desired characteristics of an electric field are determined. An electric field generation device is provided by defining a predetermined pattern of electrical conductors on a flexible dielectric substrate. The conductors are spaced apart from each other along the substrate and are carried thereon to flex with the substrate. The substrate is bent to provide a predetermined spatial orientation of the conductors. An electric potential is applied to the conductors to generate an electric field with the desired characteristics.

In yet another feature, a conduit in fluid communication with a charged particle source and a charged particle detector are combined. The conduit defines a charged particle pathway. In addition, an electric potential source and an electric field generation device are also provided. The electric field generation device includes a flexible dielectric substrate and a conductor carried on the substrate. This conductor occupies only a portion of a surface area defined by the substrate and flexes with the substrate. The conductor is electrically coupled to the electric potential source. A charged particle pathway is defined from the source to the detector. The substrate is flexed to orient the conductor about at least a portion of this pathway. This orientation is selected to provide a predetermined electric field within the conduit that is configured to control movement of charged particles along the pathway.

In a further feature, a flexible sheet is coupled to a dielectric tube. The dielectric tube receives a number of charged particles along a predetermined pathway therethrough. The flexible sheet includes a dielectric substrate carrying a number of conductors thereon. The conductors are spaced apart from one another along the substrate in a predetermined pattern and are configured to flex with the sheet. The conductors define at least two contacts for electrical coupling. The sheet is bent to orient at least a portion of the conductors about at least a portion of the tube to provide an electric field within the tube when an electric potential is applied. This electric field is configured to control movement of the charged particles along the pathway.

In accordance with an additional feature of the present invention, several spaced apart conductors are positioned about a charged particle pathway. A selectively adjustable voltage is applied to each conductor to define an electric potential well capable of selectively holding ions having a kinetic energy below a predetermined level. These conductors may be carried on a flexible dielectric substrate defined in accordance with other features of the present invention.

Accordingly, it is one object of the present invention to provide an electric field generation device suitable for use with charged particle analyzers.

It is another object of the present invention to provide for the generation of an electric field with a sheet having a flexible dielectric substrate that carries one or more conductors thereon.

It is also an object of the present invention to produce an electric field generation device by etching a conductive pattern from a metallic film clad to a flexible dielectric substrate.

It is still another object of the present invention to provide an ion gate capable of selectively collecting and then directing ions having a kinetic energy below a predetermined threshold.

An additional object of the present invention is to provide an electric field generation device suitable for use with charged particle analyzers which may be readily interchanged with other devices to change desired electric field characteristics.

Other objects of the present invention include providing an electric field generation device which may be readily assembled and disassembled, and which is quick and inexpensive to produce.

Further objects, features, aspects, benefits, and advantages of the present invention shall become apparent from the detailed drawings and descriptions provided herein.

DESCRIPTION OF THE PREFERRED EMBODIMENTS

Figure 1:
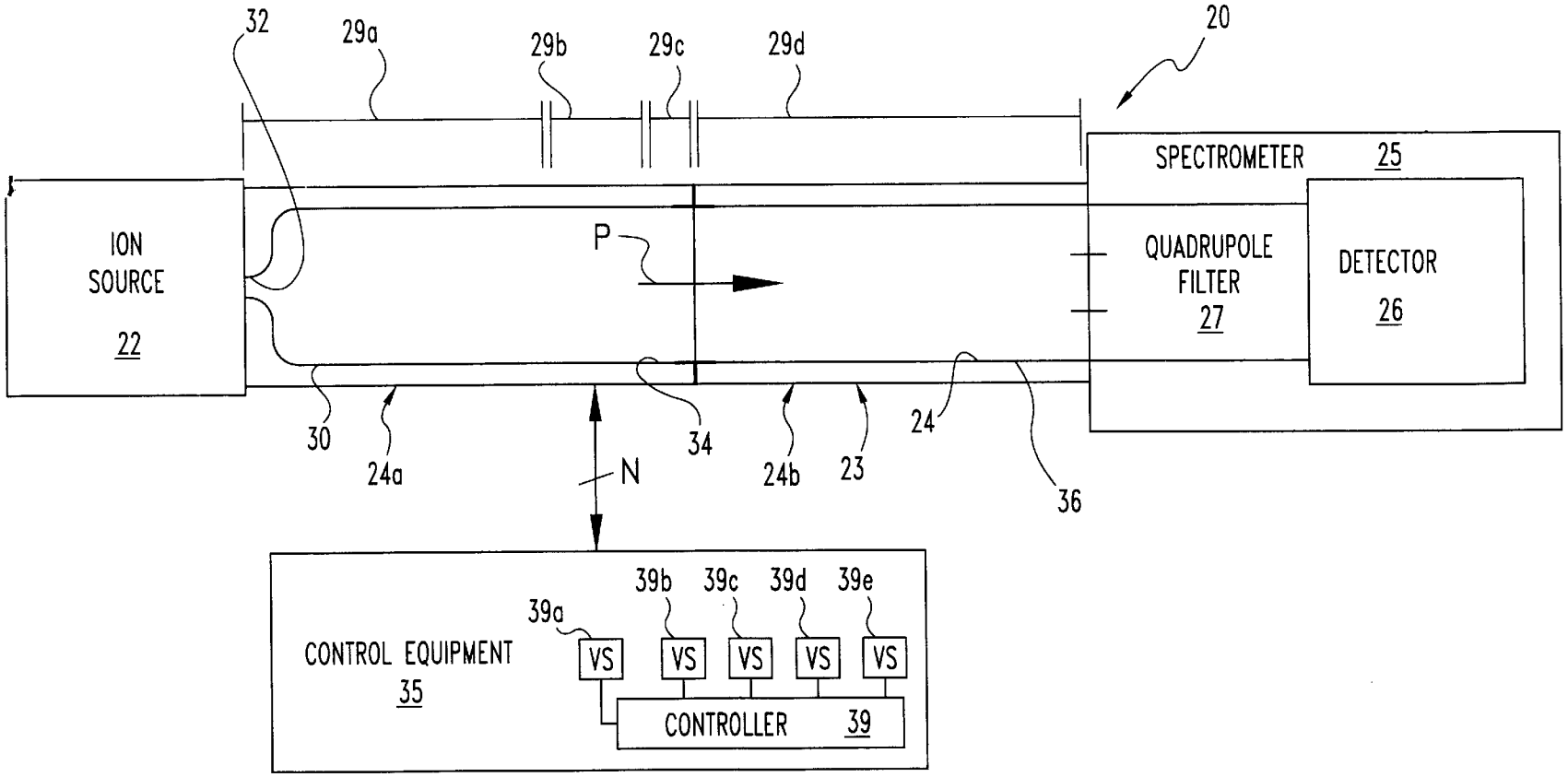
FIG. 1 is a schematic view of one embodiment of a charged particle analyzer of the present invention.
Figure 2:
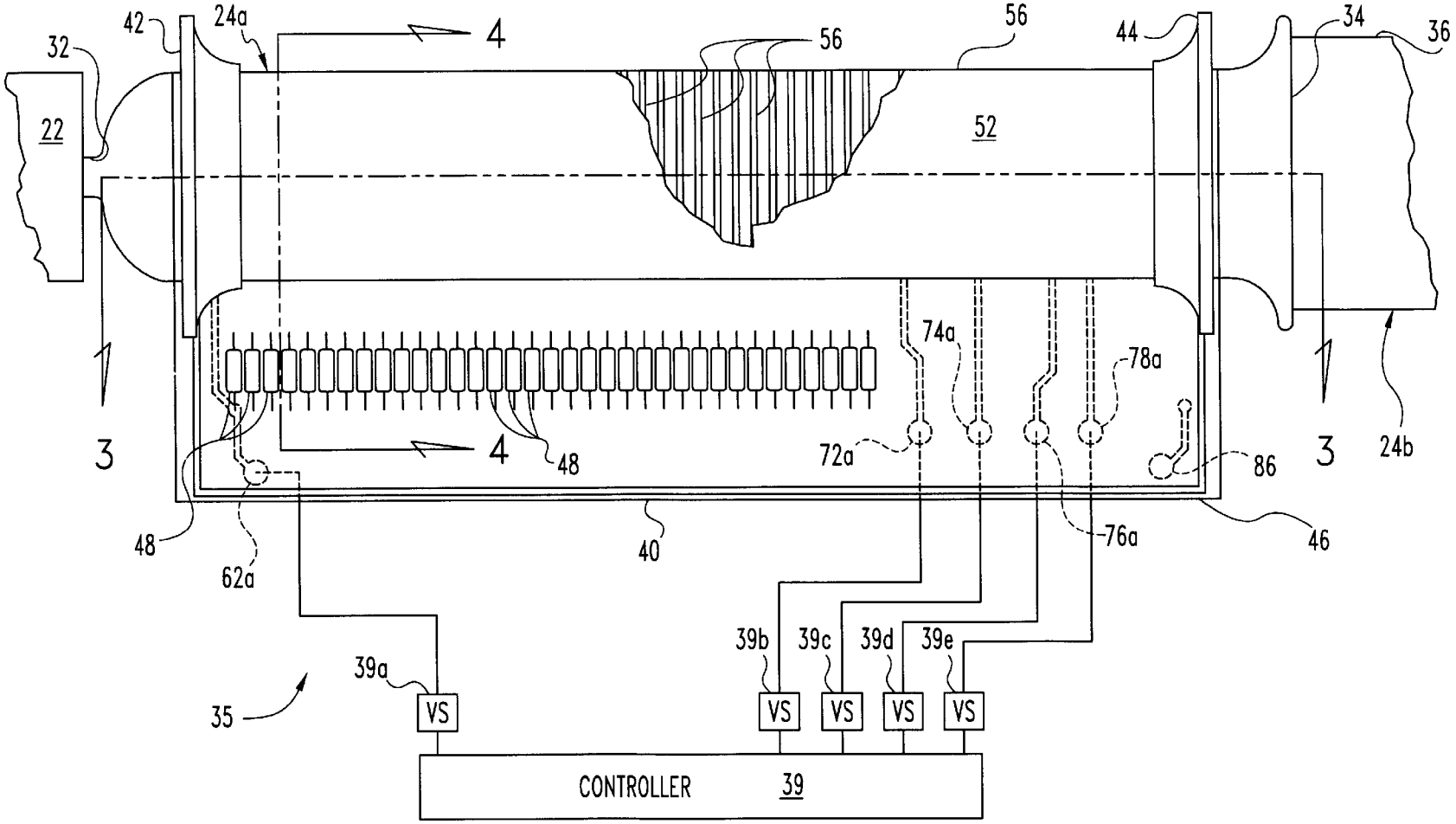
FIG. 2 is a partial cutaway side view of the embodiment of FIG. 1 showing certain aspects of a charged particle directing segment in greater detail.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described processes and devices, and any further applications of the principles of the invention as described herein are contemplated as would normally occur to one skilled in the art to which the invention relates.

One aspect of the present invention is the provision of a versatile, inexpensive, and rapid technique of creating electrostatic lenses for use in focusing charged particles. This technique utilizes a flexible substrate to carry conductors patterned from an electrically conductive material by a removal process, such as etching. The conductors and substrate may be spatially arranged to control the movement of charged particles. Several examples embodying this aspect and other aspects and features of the present invention follow, including a flex-circuit based ion mobility apparatus and a mass spectrometer; however, it should be appreciated that the present invention may be applied to control and direct charged particles in any device regardless of whether the charged particles are in a gas, liquid, or solid medium.

FIG. 1 schematically depicts one embodiment of a charged particle analyzer 20 of the present invention. Charged particle analyzer 20 includes ion source 22 and charged particle directing apparatus 23. Apparatus 23 includes coupled charged particle directing segments 24*a* and 24*b* which collectively provide conduit 24. Conduit 24 is in fluid communication with source 22 and mass spectrometer device 25 and defines charged particle pathway P therethrough. Device 25 includes detector 26 and quadrupole mass filter 27 configured in a conventional manner.

Segment 24*a* includes tube 30 with an inlet 32 coupled to receive ions from ion source 22 and outlet 34 in fluid communication with tube 36 of segment 24*b*. Tubes 30 and 36 are preferably made from a dielectric material such as glass. The locations of various electric field regions along apparatus 23 are represented by corresponding straight line segments designated by reference numerals 29*a*–29*d*. Segment 24*a* includes particle acceleration field region 29*a*, gate field region 29*b*, and particle acceleration field region 29*c*. Segment 24*b* includes particle acceleration field region 29*d*. Control equipment 35 is operatively coupled by N signal paths to various other components of analyzer 20, where N is a positive integer. Equipment 35 is configured to regulate and control selected operations of analyzer 20. Equipment 35 includes digital controller 39 and controllable voltage sources 39*a*–39*e*.

Segments 24*a* and 24*b* each include at least one electric field generation device to control movement of charged particles along pathway P. Referring to FIGS. 2–5, segment 24*a* includes tube 30 and electric field generation device 40. Device 40 is positioned between ring flanges 42 and 44 along tube 30. Electric field generation device 40 includes interconnection board 46 inserted in notches formed in ring flanges 42, 44. Stepdown resistors 48 (about 35 in number) are mounted to board 46, but only a few are specifically designated by reference numerals in order to preserve clarity. Electric field generation device 40 also includes electric field generation sheet 50 which is bent or flexed to wrap around tube 30. Sheet 50 is also coupled to resistors 48 and board 46. Controllable voltage sources 39*a*–39*e* are electrically coupled between controller 39 and device 40 as more specifically described hereinafter.

Figure 3:
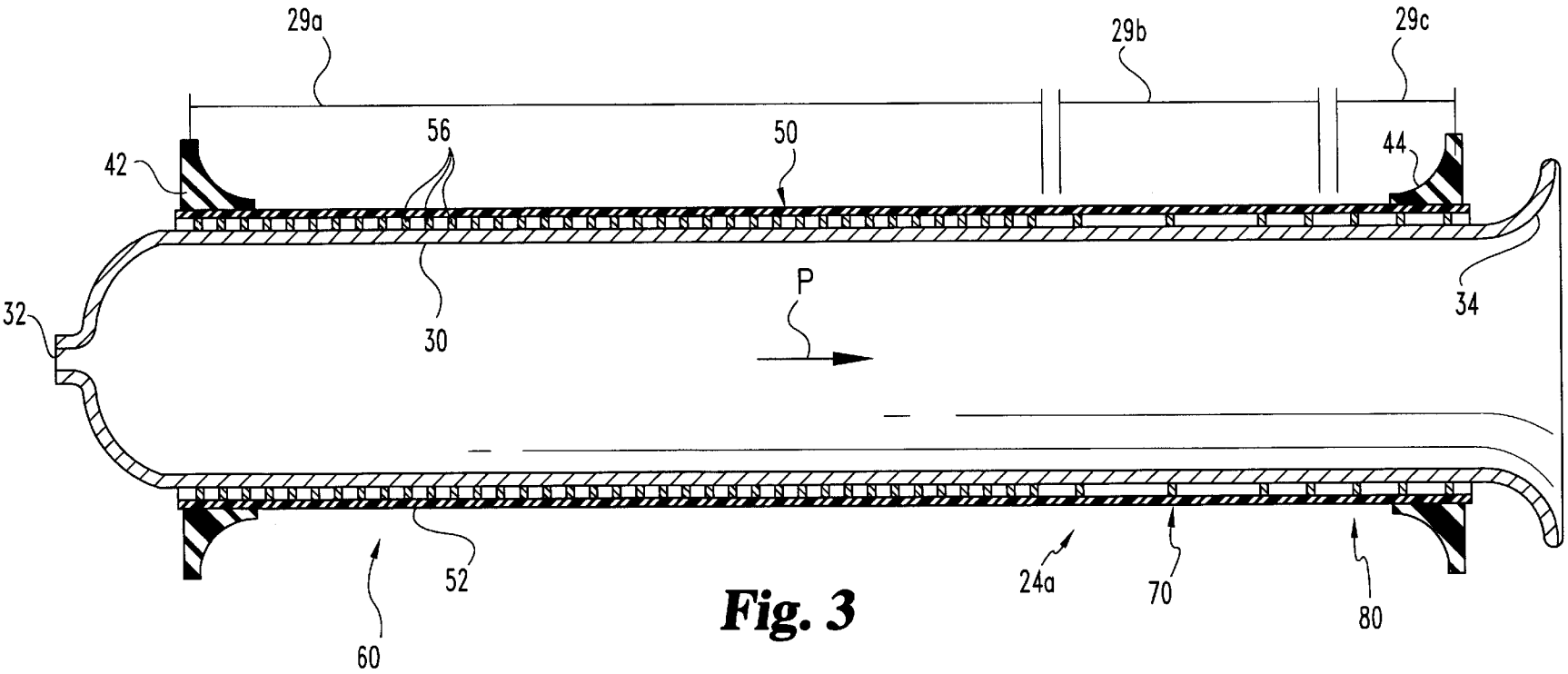
FIG. 3 is a partial cross-sectional view taken along section line 3—3 of FIG. 2.
Figure 4:
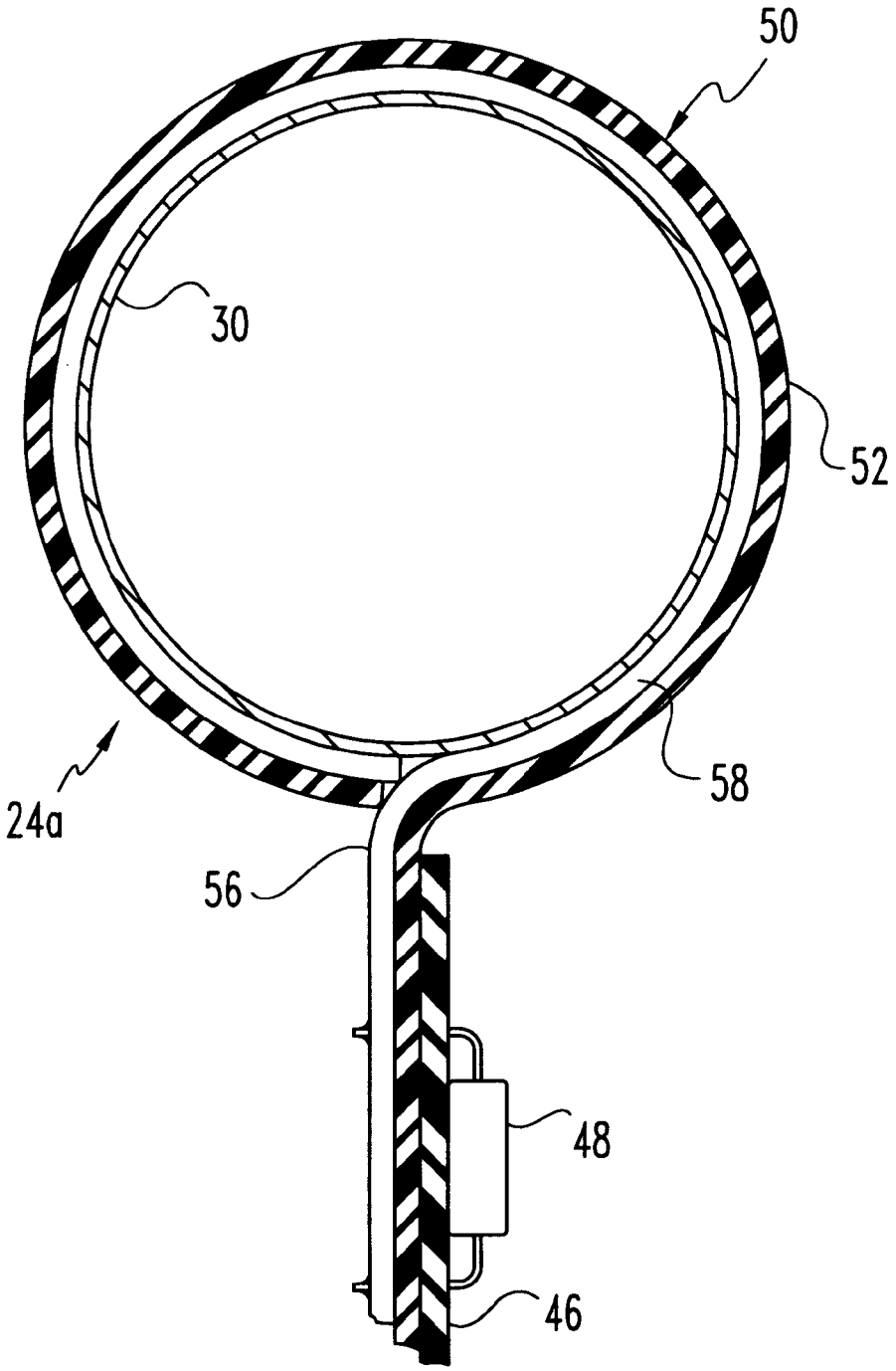
FIG. 4 is a partial cross-sectional view taken along section line 4—4 of FIG. 2.

Sheet 50 includes a flexible dielectric substrate 52 carrying an electrically conductive material layer 54. Layer 54 has been configured to define a conductive pattern 54*a*. Pattern 54*a* defines a number of conductors 56 spaced apart from each other along substrate 52. Only a few of conductors 56 are specifically designated by reference numeral to preserve clarity; however, about 44 separate operative conductors are shown. Conductors 56 are configured to flex and bend with substrate 52. Preferably, substrate 52 is formed from a polyamide or mylar material, and conductors 56 are formed from a malleable, highly conductive metallic material, such as copper. Several of conductors 56 include an elongate, straight strip 58. Strips 58 correspond to the region of sheet 50 along segment 58*a*. Strips 58 are generally parallel to each other and to segment 58*a*. When sheet 50 is wrapped around tube 30, as best illustrated in FIGS. 3 and 4, strips 58 substantially encircle tube 30 providing a corresponding number of electric field lenses. Only a few strips 58 are specifically designated in order to maintain clarity.

Conductors 56 are arranged in a number of groups. Lens group 60 is provided to generate a generally uniform electric field gradient along region 29*a* when sheet 50 is wrapped about tube 30 and a predetermined electric potential is applied to electric field generation device 40. Two lenses belonging to group 60 are identified by reference numerals 60*a* and 60*b* in FIG. 5. The conductors 56 positioned between lenses 60*a* and 60*b* also belong to group 60. For the illustrated embodiment, 36 conductors 56 are included in group 60. Lens 60*a* defines a contact 62*a* for electrically coupling to voltage source 39*a* as shown in phantom in FIG. 2. Lens 60*b* defines a pad 66*a* for electrical coupling to other groups or electric potential sources. Strip 58 of each member of group 60 is generally evenly spaced apart from the others with a minimum spacing represented by straight line segment 62*b*. It is preferred that the minimum spacing represented by segment 62*b* be less than about 1 inch. More preferably, the distance represented by segment 62*b* is less than about 0.4 inch. Most preferably, the minimum distance represented by segment 62*b* is less than about 0.1 inch. It is also preferred that the minimum spacing of segment 62*b* be in a range of about 10 thousandths of an inch (10 mils) to 1 inch.

Conductors 66 of group 60 each terminate in a resistor interconnect region 64 positioned along segment 63 opposite the region defining strips 58 of group 60. Region 64 defines a number of resistor connection pads 64*a*, 64*b*, only a few of which are specifically depicted to preserve clarity. Each conductor 56 of group 60, other than lenses 60*a* and 60*b*, has one resistor pad 64*a* and one resistor pad 64*b*. Lens 60*a* has a resistor pad 64*b*, but does not have a corresponding resistor pad 64*a*. Lens 60*b* has a resistor pad 64*a*, but does not have a corresponding resistor pad 64*b*. Conductors 56 of group 60 are configured with a bend in region 64 to align each pad 64*b* with a corresponding pad 64*a* of an adjacent conductor 56. As a result, pads 64*a*, 64*b* are arranged to form about 35 pad pairs 64*c*. To preserve clarity, only a few of pairs 64*c* are specifically depicted in FIG. 5 by a double-headed arrow.

A resistor 48 is coupled between each pair 64*c* to electrically interconnect adjacent members of group 60. Resistors 48 each offer generally the same amount of electrical resistance to provide a generally uniform electric field gradient across strips 58 of group 60 when a predetermined constant electric potential is applied with voltage source 39*a*. Thus, conductors 56 of group 60 are electrically interconnected by generally equal-valued stepdown resistors.

Resistors 48 are mounted by forming a hole through each pad 64*a*, 64*b* configured to receive a corresponding resistor lead therethrough. For a given resistor 48, one resistor lead is placed through a hole defined in pad 64*a* and the other lead is placed through a hole defined in pad 64*b* in accordance with pairs 64*c*. Once a resistor 48 is received through holes formed in a pad pair 64*c*, the leads are soldered to the remaining portion of the pad to provide a reliable electrical interconnection. This through-hole mounting technique is best illustrated in FIG. 4 for a representative resistor 48. In another embodiment, resistor pads may be configured for surface mounting. In still other embodiments, resistors may be provided in accordance with techniques known to those skilled in the art.

Pattern 54*a* also defines bridge conductor 66 with pad 66*b* and 66*c*. When electric field generation device 40 is assembled, a bridge resistor (not shown) is electrically coupled to pad 66*a* of lens 60*b* and pad 66*b* of bridge conductor 66. Preferably, this bridge resistor has a value that is a predetermined multiple of the value of resistors 48. Bridge conductor 66 is utilized to supply electric potential from lens group 60 to lens group 80. In one arrangement, the bridge resistor is about five times greater than each of resistors 48.

Between lens group 60 and lens group 80, gate 70 is illustrated. Gate 70 includes gate conductor 72 with contact 72*a*, gate conductor 74 with contact 74*a*, gate conductor 76 with contact 76*a*, and gate conductor 78 with contact 78*a*. Contacts 72*a*, 74*a*, 76*a*, and 78*a* are electrically coupled to voltage sources 39*b*–39*e*, respectively, as shown in phantom in FIG. 2. As shown in FIG. 3, gate 70 corresponds to field region 29*b* along conduit 24. Strips 58 of gate lenses 70 are spaced apart from adjacent strips 58 as represented by spacing segments 72*b*, 74*b*, 76*b*, and 78*b*. Preferably, separation distances represented by segments 72*b* and 78*b* are generally equal to one another and about twice the distance represented by segment 62*b* for group 60. Also, it is preferred that the distances represented by segments 74*b* and 76*b* be generally equal and about twice the distance represented by segments 72*b* and 78*b*.

Lens group 80 corresponds to field region 29*c* along conduit 24. Group 80 includes lens 82 with pad 82*a* aligned for interconnection to pad 66*c* of bridge connector 66 by a resistor or jumper. Lens 82 also has resistor pad 82*b*. Lens group 80 further includes lens 84 adjacent to lens 82 which has pads 84*a* and 84*b*. Pad 84*a* aligns with pad 82*b* to provide for resistive interconnection to step down voltage in a manner similar to that described for group 60. Pad 84*b* aligns with pad 86*a* of bridge connector 86 to be interconnected by a resistor or jumper. Bridge conductor 86 includes contact 86*b*. Preferably, contact 86*b* interconnects to a conductor associated with an electric field generation device for tube 36 of analyzer 20 to continue the electric field gradient along segment 24*b*.

In operation, ion source 22 is used to generate ions for passage through conduit 24. Source 22 may be of a conventional type. Inlet 32 of tube 30 is configured to receive and accelerate ions away from a needle provided by an electrospray variety of ion source 22; however, other varieties of an ion source as would occur to one skilled in the art are also envisioned, such as the Matrix Assisted Laser Desorption/Ionization (MALDI) type described in U.S. Pat. No. 5,510,613 to Reilly et al. Ions from source 22 are initially accelerated by the generally uniform electric field gradient in region 29*a* resulting from application of a generally constant electric potential across the conductors 56 and resistors 48 associated with group 60 (see FIG. 3). Preferably, conduit 24 is filled with a non-reactive gas (such as dry nitrogen) from a gas supply (not shown) coupled thereto to provide a drift tube operationally similar to drift tubes in conventional ion mobility detectors. For this embodiment, ions generally reach a terminal velocity due to collisions with the gas. In an alternative embodiment, conduit 24 may be evacuated so that the constant electric field gradient of region 29*a* provides constant acceleration of the ions along pathway P.

The electric field provided by group 60 in field region 29*a* is controlled and regulated by controller 39 via voltage source 39*a*. Controller 39 preferably provides one or more digital signals to voltage source 39*a* which are converted to a DC control voltage therein to maintain or adjust voltage across group 60. The generally equal value of resistors 48 interconnecting the generally evenly spaced strips 58 of group 60 from voltage source 39*a* provide the generally uniform electric field gradient when a constant electric potential is applied.

In one preferred embodiment, an electric potential of about 23,000 volts is applied to contact 62*a* by voltage source 39*a*. Lens group 60 and resistors 48 are configured to step down this electric potential in about 72.86 volt increments to present about 20,450 volts at lens 60*b*.

After region 29*a*, ions continue to travel through tube 30 to encounter an electric field generated by gate 70 in field region 29*b*. Gate 70 defines an adjustable "potential energy well" corresponding to the electric potential levels supplied to gate conductors 72, 74, 76 and 78 by voltage sources 39*b*–39*e*, respectively.

Figure 6:
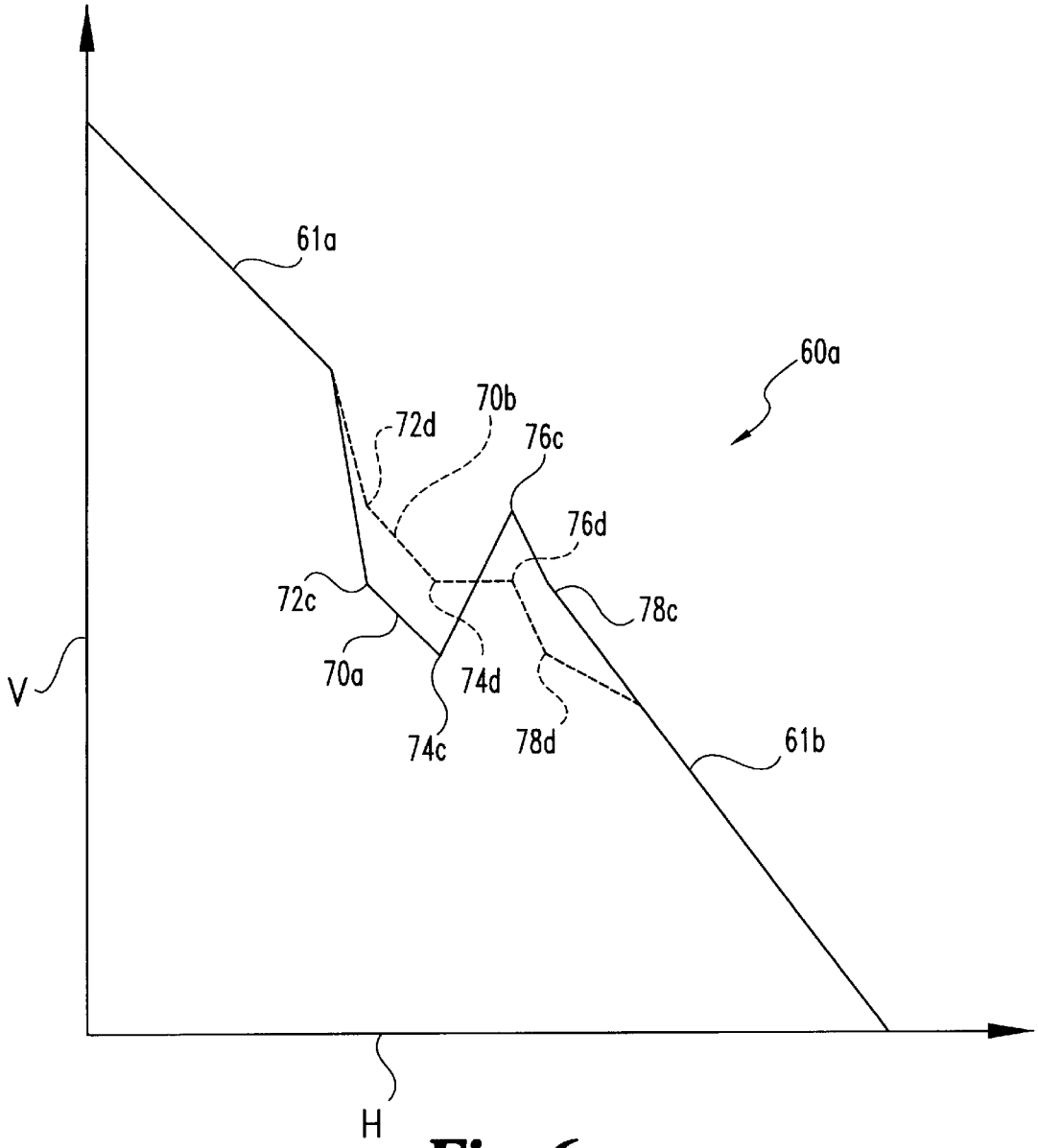
FIG. 6 is a graph depicting certain aspects of the operation of the electric field gate provided by the embodiment of FIG. 1.

Referring to FIG. 6, graph 60*a* illustrates selected operational aspects of gate 70. Vertical axis V of graph 60*a* represents voltage level and horizontal axis H represents distance along path P. Negatively sloped line segment 61*a* corresponds to the generally uniform gradient of the electric field in region 29*a*. Negatively sloped line segment 61*b* corresponds to a generally uniform electric field gradient preferred for field regions 29*c* and 29*d*.

Between segments 61*a* and 61*b*, solid lines represent an electric potential well profile 70*a*. Points 72*c*, 74*c*, 76*c*, and 78*c* correspond to electric potential levels of gate conductors 72, 74, 76, and 78, respectively. These potential levels are arranged to hold ions having a kinetic energy below a predetermined level as imparted by the electric field from group 60. Ions with kinetic energy below this predetermined level cannot overcome the positively sloped gradient represented by the solid line segment between points 74*c* and 76*c*. In contrast, ions having a kinetic energy above this predetermined level can overcome this positively sloped gradient to continue travel along pathway P.

When it is desired to release ions held by the electric potential well represented by profile 70*a*, the electric potential of each gate conductor 72, 74, 76, 78 is adjusted by controller 39 via voltage sources 39*b*–39*e* to provide the release profile 70*b* represented by dashed lines in FIG. 6. For profile 70*b*, points 72*d*, 74*d*, 76*d*, and 78*d* represent electric potential levels on gate conductors 72, 74, 76, and 78, respectively.

For the preferred embodiment of group 60 having an input electric potential level of about 23,000 volts stepped down in about 72.86 volt increments to provide about 20,450 volts on lens 60*b* as previously described, well profile 70*a* is defined by applying about 20,000 volts to gate conductor 72, about 19,850 volts to gate conductor 74, about 20,150 to gate conductor 76 and about 20,000 volts to gate conductor 78. For the embodiment, the release profile 70*b* is provided by applying about 20,150 volts to gate conductor 72, about 20,000 volts to gate conductor 74, about 20,000 volts to gate conductor 76 and about 19,850 to gate conductor 78.

With gate 70, ions below a selected kinetic energy may be held then controllably released for subsequent analysis. This permits the concentration of ions with predetermined characteristics to be separated from other ions for further study or removal. In one case, a gate may be utilized to separate ionized water molecules that frequently interfere with spectrographic analysis of a sample of interest. In other cases, several gates may be utilized in series to capture ions within corresponding increasing kinetic energy ranges—effectively defining kinetic energy windows along the tube. The ions captured in each gate may be released at an appointed time for processing downstream or side ejected into a collection system or into one or more parallel charged particle analyzers (not shown). This configuration is especially amenable to the evaluation of large complex biomolecules.

Furthermore, in other embodiments, more or fewer gate conductors and adjustable potential sources may be utilized. In one alternative embodiment, a single gate conductor is positioned between two constant gradient fields which is attached to an adjustable voltage source. The potential on the single conductor may be varied to selectively provide an ion capturing well. Furthermore, it should be appreciated that for a gate with multiple conductors, a separate, independently adjustable voltage source for each conductor may not be needed to define a suitable electric potential well for a given application.

It should also be appreciated that field generation sheet 50 readily maintains spacing between conductors operable as electric field lenses without exhaustive assembly about tube 30. Accordingly, electric field generation device 40 may be configured for rapid removal about tube 30 to accommodate cleaning and interchange with other electric field generation devices defining electric fields with different properties. In this manner, reconfiguring a charged particle analyzer with different acceleration fields or different gate arrangements may be accommodated.

After gate 70, ions encounter region 29*c* having an accelerating electric field provided by group 80. The field in region 29*c* is generated by interconnection to group 60 to commonly utilize voltage source 39*a*. Lens 82 of group 80 is electrically coupled to lens 60*a* of group 60 via conductor 66 with a coupling resistance selected to provide a predetermined voltage drop typically greater than the stepdown increments defining the gradient. This predetermined voltage drop is selected to permit adjustments to the electric potentials on conductors 72, 74, 76, and 78 needed for the proper operation of gate 70. Lens 84 is preferably interconnected to lens 82 by a resistor configured to provide a field gradient equivalent to the gradient provided by group 60;

taking into account the greater spacing between lens 82 and 84 as compared to members of group 60. Lens 84 is coupled to bridging conductor 86 by a jumper or resistor as required. Contact 86*b* of conductor 86 may be coupled to a voltage source, the electric field generation device of segment 24*b*, or both to provide the appropriate electric field arrangement.

After region 29*c*, ions travel under the influence of the electric field generated by group 80 from tube 30 into tube 36. Correspondingly, ions encounter an accelerating electric field with a generally constant gradient in field region 29*d*. Preferably, the field gradient in region 29*d* is generally constant and continuous with the gradient of the field emanating from lenses 82 and 84 of group 80. The field in region 29*d* may be generated using source 39*a* or a different electric potential source. The field in region 29*d* may be provided in accordance with the present invention using a flexible dielectric substrate carrying conductors spaced apart from each other as in group 60 or 80 with appropriate stepdown resistors. Alternatively, the field in region 29*d* may be provided using conventional techniques. In one conventional arrangement, the electric field generation device for region 29*d* has lenses separated from each other by spacing about five times greater than the conductors of group 60. To maintain the preferred gradient, stepdown resistors with a value correspondingly five times greater are required. For this spacing, it should be appreciated that tube 36 must be longer, increasing weight and size, and the interconnecting stepdown resistors for the field in region 29*d* must dissipate more power to provide a field gradient comparable to that provided by group 60.

In an embodiment employing this conventional arrangement for the field in region 29*d*, tube 30 is about seven inches in length and tube 36 is about 26 inches in length. Further, for this embodiment, a 3,000 volt D.C. voltage supply is electrically connected in series with a 20,000 volt D.C. voltage supply to provide a total of 23,000 volts across apparatus 23. The 3,000 volt supply, provided by Bertran Associates (model series 225), has the positive side electrically connected to contact 62*a* and the negative side connected to contact 86*b*. Contact 86*b* is also coupled to the positive side of the 20,000 volt supply (provided by Spellman with a business address of 475 Wireless Blvd., Hauppauge, N.Y.). The 20,000 volt supply provides the electric potential for the conventional electric field generation device of segment 24*b*. The negative side of the 20,000 volt supply is grounded. For this embodiment, controller 39 includes a personal computer operatively coupled to the 3,000 and 20,000 volt supplies to provide digital control signals that are correspondingly converted into D.C. control voltages to direct the high voltage outputs. Furthermore, in lieu of independently controlled voltage sources 39*b*–39*e*, a gate pulser is coupled to the personal computer and each conductor 72, 74, 76, 78 of gate 70 for this arrangement; however, the operation of gate 70 with this pulser is generally the same as for the embodiment described in connection with independently controllable voltage sources 39*b*–39*e*. The pulser circuit is configured with four voltage drivers having independently adjustable voltage output levels coupled to the respective conductors. These drivers are simultaneously sequenced to either create a collection potential well or eject collected charged particles. In other embodiments, different arrangements of voltage sources and controllers are employed as would occur to one skilled in the art.

Ions travel from segment 24*b* to mass spectrometer 25. Device 25 may be of a conventional type such as the 150-QC quadrupole model supplied by ABB Extrel Division, ABB Process Analytics with a business address of 575 Epsilon drive, Pittsburgh, Pa. 15238. Device 25 includes a processing apparatus which may be considered a portion of controller 39. In one arrangement, one or more signal ports of the model 150-QC quadrupole mass spectrometer are coupled to a personal computer that controls the voltage sources connected to apparatus 23.

Ions enter filter 27 to be sequentially spread-out in accordance with their mass/charge ratio for subsequent detection by detector 26 using conventional techniques. Detector 26 generates one or more signals corresponding to detected ions which have exited from filter 27. In response, equipment 35 may generate one or more output signals to convey information about a sample from which the ions are sourced. After appropriate processing, data may be provided through visual graphic means, printed in hard-copy form, recorded in non-volatile memory, or a combination of these. Other data processing as would occur to one skilled in the art is also envisioned.

Figure 5:
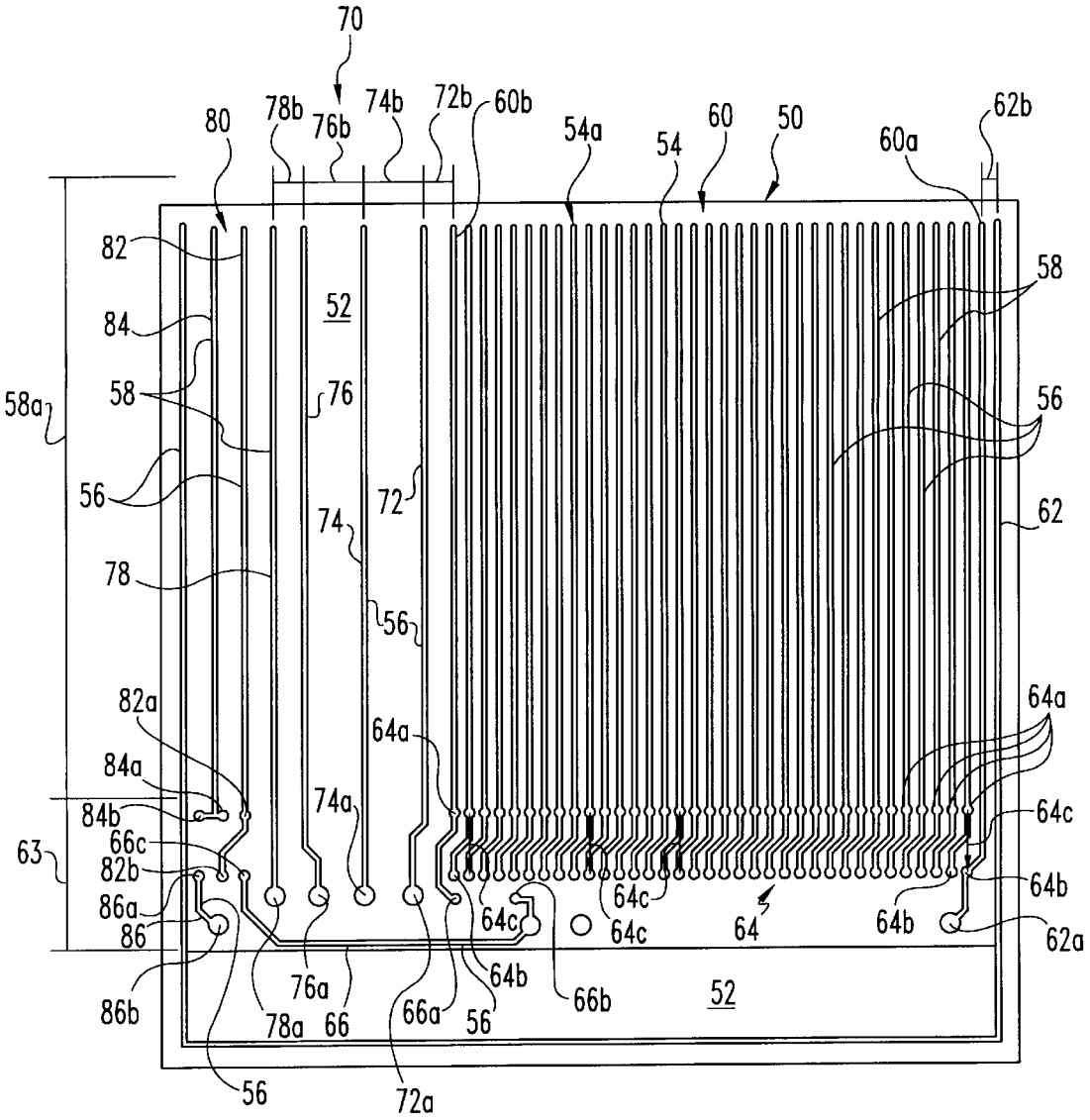
FIG. 5 is a plan view of an electric field generation sheet shown in FIGS. 2–4.
Figure 5A:
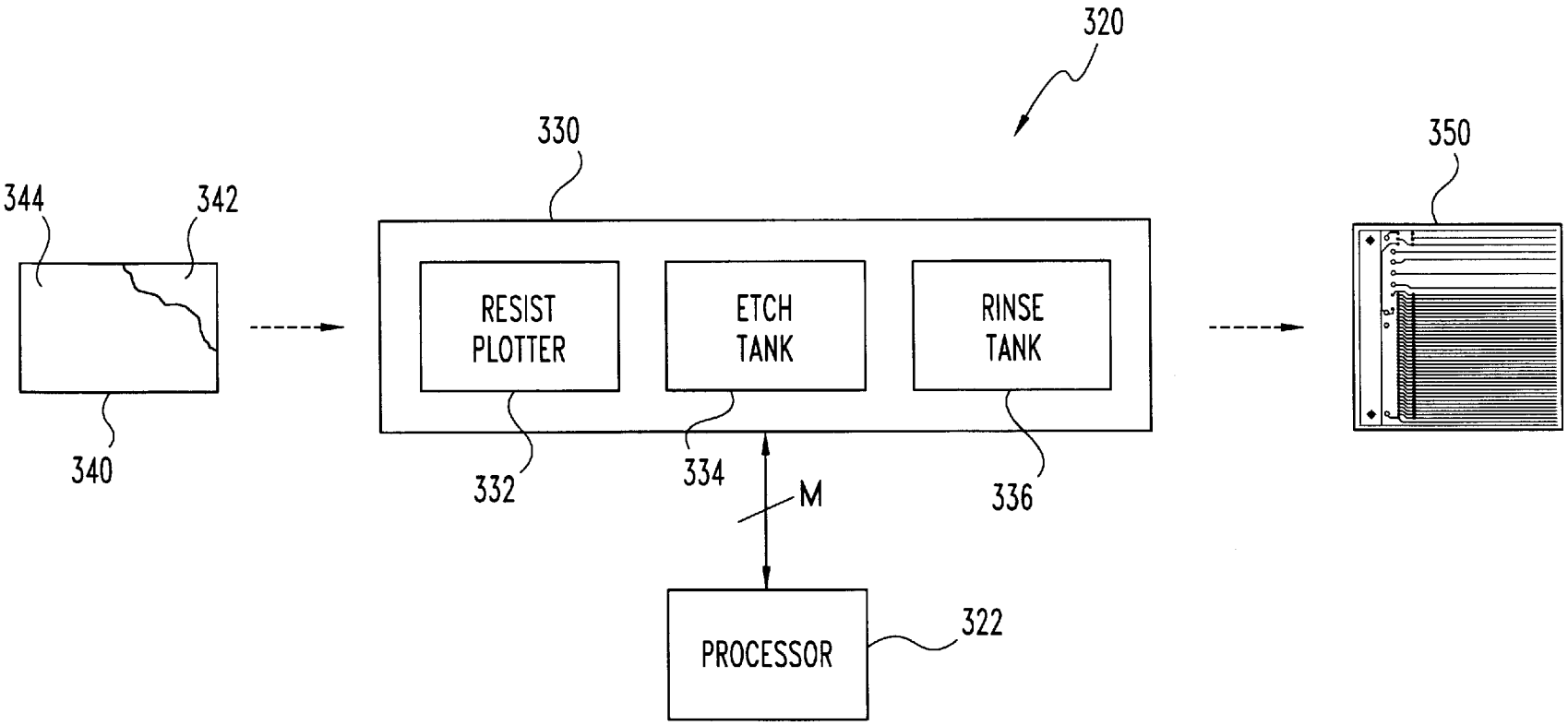
FIG. 5*a* is a schematic view of a system for making the sheet shown in FIG. 5.

FIG. 5*a* depicts system 320 for designing and producing electric field generation sheets such as sheet 50. System 320 includes processor 322 operatively coupled by M lines to processing station 330, where M equals a positive integer. It is preferred that the processor 322 be an industrial-grade, ruggedized programmable personal computer with customized software and hardware to practice the present invention. This preferred configuration may include communication interfaces such as modem or network links, and subsystems to accommodate removable media, such as compact disks (CDs) or floppy disks. Processor 322 may be a collection of one or more electronic components or a single custom-integrated component. The processor circuitry may comprise digital circuits, analog circuits, fuzzy logic circuits, or a combination of these circuit types. Although it is preferred that the processor be readily re-programmable by software, it may also be programmed by firmware, or be configured as a integrated state machine, or employ a combination of these techniques.

Station 330 includes plotter 332 configured to plot a pattern in etch resist ink in response to input from processor 322. Station 330 also includes an etch tank 334 and a rinse tank 336. Preferably, tanks 334 and 336 are in fluid communication with one or more spraying devices to apply an appropriate etch solution or rinse solution, respectively, in response to appropriate signals from processor 322.

System 320 also depicts a partial cutaway view of an unprocessed sheet 340. Sheet 340 has flexible dielectric layer 342 shown in the cutaway and an electrically conductive layer 344 clad to layer 342. For sheet 340, conductive layer 344 is generally coextensive with layer 342. Preferably, layer 342 is made from a polyamide or mylar material and layer 344 is formed from a metallic material such as copper, although other materials envisioned by those skilled in the art may alternatively be utilized. A finished sheet for which conductive layer 344 has been selectively removed from layer 342 is depicted by reference numeral 350. For sheet 350, the resulting conductive pattern of the remaining conductive layer 344 occupies only a portion of the surface area defined by layer 342; such that layer 342 is partially exposed and is no longer coextensive with conductive layer 344.

Figure 5B:
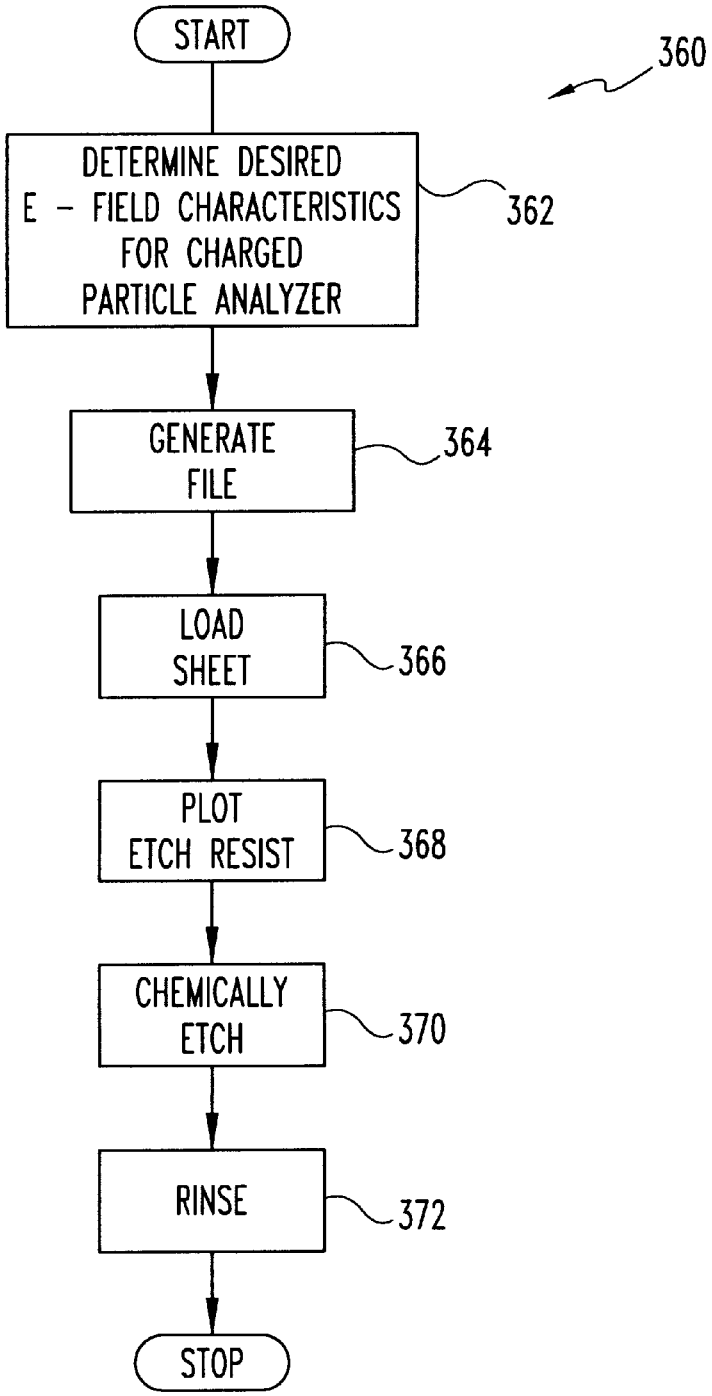
FIG. 5*b* is a flow diagram of a process for making the sheet shown in FIG. 5 with the system of FIG. 5*a*.

Referring additionally to FIG. 5*b*, a flow chart of process 360 in accordance with the present invention is illustrated. In operation 362 of process 360, the desired characteristics of an electric field for use in a charged particle analyzer are determined. This process may entail determining an electric field gradient for an acceleration field, the geometry of conductors from which the field will emanate, the spatial orientation of the field as related to the supplying conductors, needed electric potential input, the spacing and arrangement of any gates to capture ions of a selected kinetic energy, and various other properties as would occur to one skilled in the art.

In operation 364, processor 322 is utilized to generate a data file using computer-aided design (CAD) software that will provide a graphic representation of a conductive pattern corresponding to the desired electric field characteristics determined in operation 362. Operation 364 may include various data translations as required to provide a data format compatible with station 330.

In operation 366, sheet 340 is provided to station 330. Station 330 is activated to define a pattern in etch resist ink on conductive layer 344 of sheet 340 with plotter 332 in operation 368. The sheet is then exposed to chemical etchant from tank 334 in operation 370. The etchant is configured to remove conductive film 344 to expose dielectric layer 342 in accordance with the defined pattern. Conductive layer 344 only remains where covered by the etch resist ink supplied during operation 368. The etched sheet is then rinsed to remove remaining etchant in operation 372. The patterned sheet is then output as sheet 350. It should be understood that the particular etchant and rinse solutions should be selected to correspond to the composition of layer 342 and conductive layer 344; such that conductive layer 344 is controllably and selectively removed from layer 342.

In one embodiment, system 320 and corresponding process 360 are implemented using hardware and software supplied under the SYSTEM TWO trademark by Direct Imaging of Vermont, Inc. having a business address of 30 A Street, P.O. Box 820 Wilder, Vt. 05088. This system may be used to design and develop printed circuit board prototypes having one or more flex-print layers. In this embodiment of the present invention, the system is used to print and etch the desired E-field design on flexible dielectric layer 342. Also, this system may be configured to accommodate through-hole and surface mounting of components. Furthermore, the system may be utilized to define card edge connection lands to increase the ease with which sheets may be connected to voltage supplies or interconnected with other equipment. In one embodiment, the field generation sheet is configured with edge connectors on opposite ends so that it may be removed and replaced from around a tube without needing to remove the tube from the analyzer.

With system 320 and process 360, different electric field arrangements for charged particle analyzers may be rapidly designed and produced, providing significant savings over conventional electric field generation device manufacture. The ability to customize fields quickly facilitates the development of dedicated charged particle analyzers having an array of ion capture gates, acceleration fields, and other particle control fields.

Figure 7:
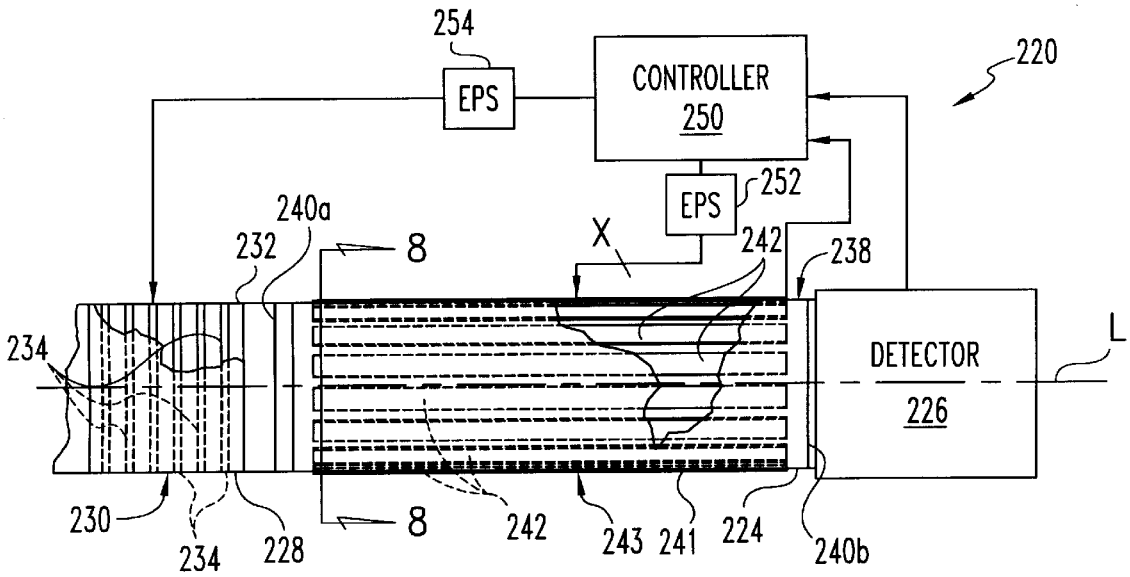
FIG. 7 is a partial cutaway side view of another embodiment of a charged particle analyzer of the present invention.

For example, FIG. 7 partially depicts a charged particle analyzer 220 of another embodiment of the present invention. Charged particle analyzer 220 includes conduit 224 with tube 228 terminating in focus lens arrangement 230. Arrangement 230 includes a flexible dielectric substrate 232 and a number of conductive lens strips 234 carried on substrate 232 and positioned generally perpendicular to longitudinal axis L. Ions are configured to travel from tube 228 to multipole mass filter 238 along axis L.

Ions enter multipole mass filter 238 through inlet 240*a* and exit through outlet 240*b* to encounter detector 226. Detector 226 is of a conventional variety configured to detect ions exiting from filter 238, and generate a corresponding signal. Detector 226 and multiple mass filter 238 are operatively coupled to controller 250. Controller 250 receives signals from detector 226 corresponding to detected ions to provide desired evaluation output and receives information from filter 238 to regulate the operation thereof. Controller 250 is also operatively coupled to arrangement 230 and conductors 242 by intervening electric potential sources 252 and 254. Source 254 is coupled to strips 234 of arrangement 230 to generate a field emanating from strips 234 to focus ions entering multipole mass filter 238. Preferably, source 254 is a controllable D.C. voltage supply suitable to provide a desired focusing E-field.

Source 252 is configured with X outputs to conductors 242, where X is a positive integer. The X outputs of source 252 provide a controlled output voltage to each conductor 242 of multipole mass filter 238. This voltage has a time-varying component in the Radio Frequency (RF) range and a DC offset component. In operation, conductors 242 operate as 16 different poles of multiple mass filter 238. The specific make-up of the electrical potential applied to conductors 242 to provide such operation is in accordance with the operation of conventional multipole mass filters as described, for example, in U.S. Pat. No. 5,302,827 to Foley.

Figure 8:
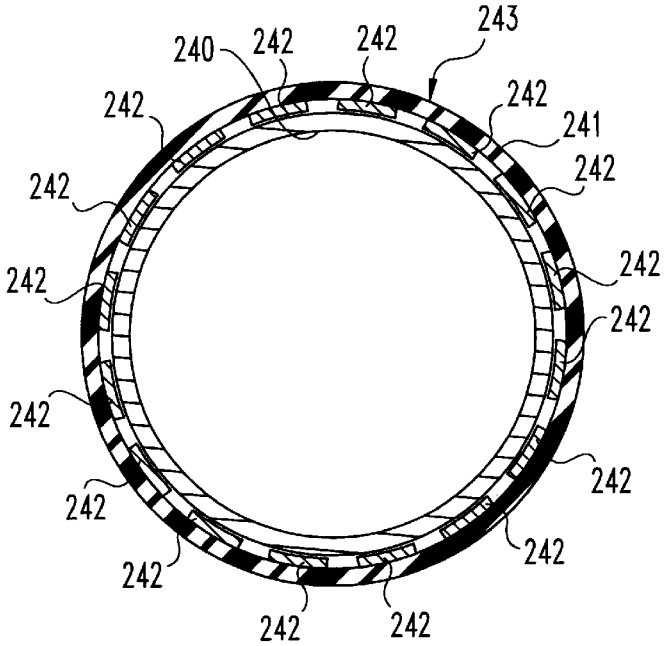
FIG. 8 is a cross-sectional view of the embodiment of FIG. 7 taken along section line 8—8 of FIG. 7.

Conductors 242 of multipole mass filter 238 are each carried by flexible dielectric substrate 241. A partial cutaway view of electric field generation sheet 243 comprising conductors 242 and substrate 241 is provided in FIG. 7. Referring additionally to FIG. 8, sheet 243 is shown wrapped about tube 240. As a result, the sixteen conductors 242 are generally arranged in a symmetric pattern about tube 240. Conductors 242 are generally, straight, elongate, and parallel to longitudinal axis L. Preferably, conductors 242 occupy about 40% to 60% of the circumference about tube 240. In other embodiments, more or fewer conductors may be used to provide a corresponding different number of poles as would occur to one skilled in the art. In one embodiment, mass filter 238 is substituted for the conventional quadrupole mass filter 27 of device 25 provided as part of analyzer 20.

Preferably, focusing lens arrangement 230 and electronic field generation device 243 are provided by process 360 using system 320 of the present invention. The resulting substrates 232, 241 are then bent or flexed about tubes 228, 240, respectively, to provide corresponding focus lens arrangement 230 and multipole mass filter 238.

Referring generally to the embodiments of FIGS. 1–8, controller 39, 250 may be an electronic circuit comprised of one or more components and may include a collection of operatively coupled processing equipment. Similarly, controller 39, 250 may be comprised of digital circuitry, analog circuitry, or both. Also, controller 39, 250 may be programmable, an integrated state machine, or a hybrid combination thereof.

In addition, while the preferred cross-sectional shape of tubes 30, 228, 240 is generally circular, other geometries are also contemplated. For example, in one alternative embodiment, a flexible substrate carrying conductors to define a desired E-field is oriented about a conduit having a generally rectangular cross-section. So configured, this rectangular conduit may be employed as a waveguide to direct charged subatomic particles by providing a suitable electric potential to the conductors. In still other embodiments, different geometric arrangements are utilized as would occur to one skilled in the art.

It is contemplated that various elements, devices, components, operators, operations, stages, conditionals, procedures, thresholds, and processes described in connection with the present invention could be altered, rearranged, substituted, deleted, duplicated or combined as would occur to those skilled in the art without departing from the spirit of the present invention.

All publications, patents, and patent applications cited in this specification are herein incorporated by reference as if each individual publication, patent, or patent application were specifically and individually indicated to be incorporated by reference and set forth in its entirety herein.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A combination, comprising:

determining desired characteristics of a first electric field configured to control charged particles in a charged particle analyzer;

providing a first electric field generation device corresponding to said determining by:

defining a predetermined pattern of electrical conductors on a flexible dielectric substrate, the conductors being spaced apart from each other along the substrate and being carried on the substrate to flex therewith;

bending the substrate to provide a predetermined spatial orientation of the conductors; and applying an electric potential to the conductors to generate the first electric field.

2. The combination of claim 1, further comprising characterizing a second electric field and providing a second electric field generation device interchangeable with the first electric field generation device, the second electric field differing from the first electric field in a predetermined manner.

3. The combination of claim 1, wherein the desired characteristics include orientation of the first electric field relative to a predetermined pathway of ions in the analyzer and gradient of the first electric field along the pathway.

4. The combination of claim 1, wherein said defining includes positioning a first one of the conductors between a second one of the conductors and a third one of the conductors along a charged particle pathway within the analyzer, and further comprising selectively generating a first electrical potential difference between the first one of the conductors and the second one of the conductors and a second electric potential difference between the second one of the conductors and the third one of the conductors, the first difference being greater than the second difference to define an electric potential well to selectively hold ions traveling along the pathway.

5. The combination of claim 4, further comprising changing the first difference so that the second difference is greater to release the ions.

6. The combination of claim 1, wherein the first electric field generation device is configured to provide a multipole mass filter.

7. The combination of claim 1, wherein the analyzer includes a dielectric tube defining a charged particle pathway and said bending includes positioning the conductors about the pathway.

8. The combination of claim 1, wherein said defining includes etching a metal-clad portion of the substrate to provide the conductors.

9. The combination of claim 1, wherein said applying includes applying an RF voltage to the conductors.

10. The combination of claim 1, wherein said applying includes applying a DC voltage to the conductors.

11. The combination of claim 1, wherein said applying includes applying a voltage to the conductors, having an RF component and a DC component.

12. The combination of claim 1, wherein the conductors include a number of generally parallel conductive strips that substantially encircle a charged particle pathway defined by the charged particle analyzer and the strips are approximately perpendicular to the pathway.

13. The combination of claim 1, wherein the conductors include a number of generally parallel conductive strips that are approximately parallel to a charged particle pathway defined by the charged particle analyzer.

14. A combination, comprising:

defining a first spatial pattern corresponding to a first electric field;

applying etch resist to an electrically conductive layer clad to a flexible dielectric substrate in accordance with the first pattern;

removing a portion of the layer by exposure to an etchant to provide a spatial arrangement of conductive material in accordance with the first pattern;

generating the first electric field with the desired characteristics by applying an electric potential to the spatial arrangement of conductive material; and controllably moving ions along a pathway in a charged particle analyzer with the first electric field.

15. The combination of claim 14, further comprising establishing a second spatial pattern different from the first spatial pattern to provide a second electric field for controlling movement of charged particles in the analyzer.

16. The combination of claim 14, further comprising wrapping the substrate around a conduit defining the pathway to at least partially surround the pathway.

17. The combination of claim 14, wherein the conductive layer includes copper and the substrate includes polyamide or mylar.

18. The combination of claim 14, wherein the electric potential includes a time varying voltage in the RF frequency range.

19. A combination, comprising:

establishing a charged particle pathway;

providing a predetermined pattern of electrical conductors on a flexible dielectric substrate, the conductors being spaced apart from each other along the substrate and being carried on the substrate to flex therewith;

positioning the substrate in a predetermined spatial orientation relative to the pathway to arrange the conductors about at least a portion of the pathway; and generating an electric field by applying an electric potential to the conductors, the electric field being configured to control movement of charged particles along the pathway.

20. The combination of claim 19, wherein the conductors include a number of generally straight elongate conductive strips parallel to one another and further comprising orienting the longitudinal axis of each of the strips generally perpendicular to the charged particle pathway.

21. The combination of claim 19, wherein the conductors include a number of generally straight elongate conductive strips parallel to one another and further comprising orienting the longitudinal axis of each of the strips generally parallel to the charged particle pathway.

22. The combination of claim 19, wherein the first electric field defines an electric field well to selectively hold ions.

23. The combination of claim 19, further comprising electrically interconnecting the conductors with a corresponding number of resistors, the resistors each having generally the same value to provide a generally uniform electric field gradient along a portion of the pathway.

24. A combination, comprising:

a charged particle source;

a conduit in fluid communication with said source;

a charged particle detector in fluid communication with said conduit; and a first electric potential source;

an electric field generation device including a flexible dielectric substrate, and a first conductor carried on said substrate, said first conductor occupying only a portion of a surface area defined by said substrate, said first conductor being configured to flex with said substrate and being electrically coupled to said first electric potential source;

wherein a charged particle pathway is defined from said source to said detector, said substrate is flexed to orient said first conductor about at least a portion of said charged particle pathway, said orientation is selected to provide a predetermined electric field within said conduit, and said electric field is configured to control movement of charged particles along said pathway.

25. The combination of claim 24, further comprising a controller operatively coupled to said first electric potential source.

26. The combination of claim 25, further comprising:

a second conductor carried on said substrate, said second conductor being spaced apart from said first conductor by a predetermined distance; and a second electric potential source coupled to said second conductor, said second electric potential source being operatively coupled to said controller;

wherein said controller adjusts output from at least one of said first and second electric potential sources to selectively hold charged particles.

27. The combination of claim 24, further comprising a plurality of conductors carried on said substrate, said first conductor belonging to said plurality of conductors, said conductors being spaced apart from one another along said substrate and each being configured to flex with said substrate.

28. The combination of claim 27, wherein said conductors include a number of generally parallel conductive strips that substantially encircle said pathway and are approximately perpendicular to said pathway.

29. The combination of claim 27, wherein said conductors include a number of generally parallel conductive strips that are generally parallel to said pathway.

30. The combination of claim 27, further comprising a number of resistors electrically interconnecting said conductors to provide a generally uniform electric field gradient.

31. A combination, comprising:

a dielectric conduit configured to receive a number of charged particles along a predetermined pathway therethrough; and a flexible sheet coupled to said conduit, said sheet including a dielectric substrate carrying a number of conductors thereon, said conductors being spaced apart from one another along said substrate in a predetermined pattern and being configured to flex with said sheet, said conductors defining at least two contacts for electrical coupling, said sheet being bent to orient at least a portion of said conductors about at least a portion of said conduit to provide a predetermined electric field within said conduit when a predetermined electric potential is applied to said conductors, said electric field being configured to control movement of the charged particles along said pathway when the charged particles are received in said conduit.

32. The combination of claim 31, further comprising:

an ion source in fluid communication with said conduit;

an ion detector in fluid communication with said conduit;

an electric potential source electrically coupled to said contacts to provide said predetermined electric potential; and a controller operatively coupled to said electric potential source.

33. The combination of claim 31, further comprising a number of resistors corresponding to said conductors, said resistors electrically interconnecting said conductors to define a generally uniform electric field gradient when said predetermined electric potential is applied.

34. The combination of claim 31, wherein said sheet is wrapped around said conduit.

35. The combination of claim 31, wherein said sheet is configured to be interchanged with one of a plurality of other sheets, said other sheets each being configured to define a different electric field when coupled to said conduit.

36. The combination of claim 31, wherein said conductors include a number of conductive strips each generally parallel to one another and approximately perpendicular to said pathway.

37. The combination of claim 31, wherein said conductors include a number of conductive strips each generally parallel to one another and approximately parallel to said pathway.

38. The combination of claim 31, wherein a minimum distance separating said conductors from each other is no more than about 1 inch.

39. The combination of claim 31, wherein a minimum distance separating said conductors from each other is no more than about 0.4 inch.

40. The combination of claim 31, wherein a minimum distance separating said conductors from each other is no more than about 0.1 inch.

41. The combination of claim 31, wherein said conductors are separated from each other by a minimum distance in a range of about 10 mils to 1 inch.

* * * * *